US006796135B1

(12) United States Patent
Bhatti et al.

(10) Patent No.: US 6,796,135 B1
(45) Date of Patent: Sep. 28, 2004

(54) METHOD AND APPARATUS FOR ODOR-FREE OPERATION OF AN AIR CONDITIONING SYSTEM

(75) Inventors: Mohinder Singh Bhatti, Amherst, NY (US); Mingyu Wang, Amherst, NY (US); John Lawrence Pawlak, III, Orchard Park, NY (US)

(73) Assignee: Delphi Technologies, Inc., Troy, MI (US)

( * ) Notice: Subject to any disclaimer, the term of this patent is extended or adjusted under 35 U.S.C. 154(b) by 2 days.

(21) Appl. No.: 10/460,381

(22) Filed: Jun. 12, 2003

(51) Int. Cl.[7] ..... F24F 3/16; F25D 21/00; F25D 21/14

(52) U.S. Cl. ..... 62/150; 62/78; 62/285

(58) Field of Search ..... 62/150, 285, 78, 62/93, 176.6; 236/44 R

(56) References Cited

U.S. PATENT DOCUMENTS 5,899,082 A * 5/1999 Stein et al. ..... 62/133
6,035,649 A 3/2000 Straub et al. ..... 62/93
6,293,116 B1 9/2001 Forrest et al.
2001/0047659 A1 12/2001 Nakamura et al.
2001/0049943 A1 12/2001 Nakamura et al.

FOREIGN PATENT DOCUMENTS

JP 06156060 A * 6/1994 ..... B60H/1/32

* cited by examiner

*Primary Examiner*—Chen Wen Jiang
(74) *Attorney, Agent, or Firm*—Patrick M. Griffin

(57) ABSTRACT

The presence of sufficient condensate flow for odor-free operation of an air conditioning system is detected based on the surface temperature of a thermistor disposed in a condensate drainpipe of the evaporator and the power supplied to the thermistor. The surface temperature is used to calculate the temperatures of stagnant circumambient air and water. If the temperature for stagnant air is approximately equal to the evaporator temperature, the evaporator is too dry and the operating point of the air conditioning system is lowered to reduce the surface temperature of the evaporator. If the temperature for stagnant water is approximately equal to the evaporator temperature, the drainpipe is plugged. Alternately, a constant power is supplied to the thermistor, and its surface temperature is compared to a set of experimentally determined reference temperatures to deduce the evaporator state.

12 Claims, 5 Drawing Sheets

METHOD AND APPARATUS FOR ODOR-FREE OPERATION OF AN AIR CONDITIONING SYSTEM

TECHNICAL FIELD

This invention relates to a vehicle air conditioning or climate control system, and more particularly to a method and apparatus for biasing the operating point of the system as required to prevent the build-up of odor producing microorganisms.

BACKGROUND OF THE INVENTION

The production of offensive odors in vehicle air conditioning systems has been traced to the build-up of certain types of microorganisms on the surface of a wet evaporator core. The odor problem can occur in any air conditioning system but is most prevalent in energy efficient systems that operate the evaporator at higher than traditional temperatures in order to minimize series re-heating of evaporator outlet air to achieve a desired air discharge temperature. These issues have been generally recognized in the motor vehicle industry, as demonstrated for example, in the U.S. Pat. No. 6,035,649 to Straub et al. issued on Mar. 14, 2000. Specifically, Straub et al. posit that the odors are caused by frequent changing of the evaporator state between wet and dry as the surface temperature of the evaporator oscillates about the dew point temperature of the intake air, and therefore teach that the surface temperature of the evaporator must be continuously maintained either above or below the dew point temperature by determining the dew point temperature and controlling the evaporator temperature accordingly. However, only limited dehumidification can be achieved when the evaporator is maintained above the inlet air dew point temperature, and adequate air conditioning performance in many situations requires the evaporator surface temperature to be maintained below the inlet air dew point temperature. Indeed, we have found that maintaining the evaporator surface temperature continuously below the inlet air dew point temperature virtually ensures odor-free operation because the condensate continuously cleanses the evaporator surface of odor causing microorganisms.

While a control of the type described by Straub et al. can be used to effectively prevent air conditioning odors by maintaining the evaporator surface temperature below the inlet air dew point temperature, it requires the expense of a dew point sensor or a relative humidity sensor in order to determine the inlet air dew point temperature. Since such sensors add considerable cost to an air conditioning system, what is needed is a control that uses only inexpensive sensors to maintain the evaporator at an odor-free operating point.

SUMMARY OF THE INVENTION

The present invention is directed to an improved air conditioning method and apparatus including an evaporator that is chilled by refrigerant, where the presence of sufficient condensate flow for odor-free operation is detected based on the surface temperature of a thermistor or other electrically activated temperature sensor disposed in a condensate drainpipe of the evaporator.

In a first embodiment, the surface temperature of the drainpipe sensor is used to calculate the temperature of a stagnant fluid (air or water) in the drainpipe based on the power supplied to the sensor and the convective heat transfer characteristics of air and water. If the calculated temperature of stagnant air is approximately equal to the evaporator temperature, it is deduced that there is little or no condensate flow through the drainpipe; in this case, the evaporator is too dry and the operating point of the air conditioning system is lowered to reduce the surface temperature of the evaporator. If the calculated temperature of stagnant water is approximately equal to the evaporator temperature, it is deduced that the drainpipe is plugged; in this case, the refrigerant compressor is disabled and the operator is advised to have the air conditioning system serviced. Otherwise, the evaporator is deemed to be generating sufficient condensate to cleanse the evaporator surface of odor causing microorganisms, and there is no adjustment of the operating point of the air conditioning system.

In a second embodiment, a constant power is supplied to the drainpipe sensor, and the state of the evaporator is deduced by comparing the surface temperature of the sensor to a set of predefined reference temperatures. The predefined reference temperatures are experimentally determined for different operating conditions of the evaporator, including at least a condition for which the evaporator is too dry, and a condition for which the evaporator drainpipe is plugged. If it is deduced that the evaporator is too dry, the operating point of the air conditioning system is lowered to reduce the surface temperature of the evaporator. If it is deduced that the drainpipe is plugged, the refrigerant compressor is disabled and the operator is advised to have the air conditioning system serviced.

BRIEF DESCRIPTION OF THE DRAWINGS

FIG. 2A illustrates a condition in which little or no condensate is in the drainpipe, FIG. 2B illustrates a condition in which the drainpipe is plugged, and FIG. 2C illustrates a condition in which a significant amount of condensate is flowing through the drainpipe.

DESCRIPTION OF THE PREFERRED EMBODIMENT

Figure 1:
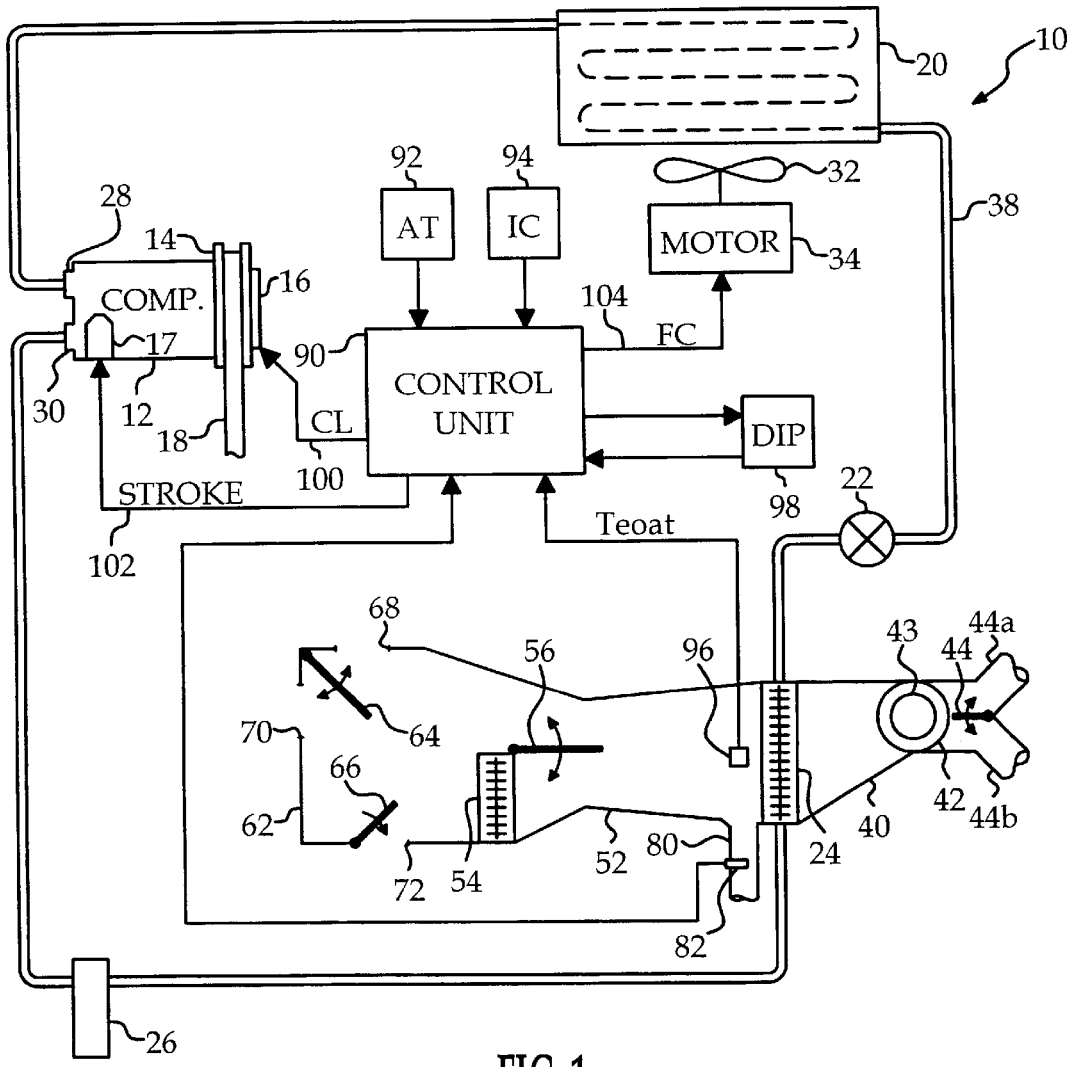
FIG. 1 is a block diagram of a vehicle air conditioning system according to this invention, including an evaporator core, a condensate drainpipe, temperature sensors disposed in the evaporator outlet airstream and in the condensate drainpipe, and a microprocessor-based control unit.

Referring to FIG. 1, the present invention is described in the context of an automatic climate control system 10 for a motor vehicle, including a refrigerant compressor 12 coupled to a rotary shaft of the vehicle engine (not shown) via drive pulley 14, electrically activated clutch 16, and drive belt 18. In the illustrated embodiment, the compressor 12 has a variable stroke for adjusting its capacity and an electrically activated stroke control valve 17 for controlling the compressor capacity. In alternate system configurations, the valve 17 may be pneumatically controlled, or the compressor 12 may have a fixed displacement, in which cases the compressor capacity can be controlled through selective activation and deactivation of the clutch 16.

A condenser 20, an orifice tube 22, an evaporator 24, and an accumulator/dehydrator 26 are arranged in order between the compressor discharge port 28 and suction port 30 of compressor 12. A cooling fan 32, operated by an electric drive motor 34, is controlled to provide supplemental air flow through the condenser 20 for removing heat from the high pressure refrigerant in condenser 20. The orifice tube 22 allows the cooled high pressure refrigerant in line 38 to expand in an isenthalpic fashion before passing through the evaporator 24. The accumulator/dehydrator 26 separates low pressure gaseous and liquid refrigerant, directs gaseous refrigerant to the compressor suction port 30, and stores excess refrigerant that is not in circulation. In an alternative system configuration, the orifice tube 22 is replaced with a thermostatic expansion valve (TXV); in this case, the accumulator/dehydrator 26 is omitted, and a receiver/drier (R/D) is inserted in line 38 upstream of the TXV to ensure that sub-cooled liquid refrigerant is available at the TXV inlet.

The evaporator 24 is formed as an array of finned refrigerant conducting tubes, and an air intake duct 40 disposed on one side of evaporator 24 houses a motor driven ventilation blower 42 driven by an electric blower motor 43 for forcing air past the evaporator tubes. The duct 40 is bifurcated upstream of the blower 42, and an inlet air control door 44 is adjustable as shown to control inlet air mixing; depending on the door position, outside air may enter blower 42 through duct leg 44*a*, and passenger compartment air may enter blower 42 through duct leg 44*b*.

An air outlet duct 52 disposed on the downstream side of blower 42 and evaporator 24 houses a heater core 54 formed as an array of finned tubes through which flows engine coolant. The heater core 54 effectively bifurcates the outlet duct 52, and a temperature door 56 is adjustable as shown to control how much of the air must pass through the heater core 54. The heated and un-heated air portions are mixed in a plenum portion 62 of outlet duct 52 downstream of temperature door 56, and a pair of mode control doors 64, 66 direct the mixed air through one or more outlets, including a defrost outlet 68, a panel outlet 70, and a heater outlet 72.

The inlet air drawn through duct legs 44*a*, 44*b* passing the finned tubes of evaporator 24 is chilled, causing water vapor in the air to condense on the cold evaporator surface. If the surface temperature of the evaporator 24 is below the dew point temperature of the inlet air, the evaporator surface collects copious amounts of condensate which cleanses the evaporator surface of odor-causing microorganisms. In any event, the condensate collects near the bottom of evaporator 24, and is exhausted beneath the vehicle via the drainpipe 80.

The above-described system 10 is controlled by the microprocessor-based control unit 90 based on various input signals, including those generated by ambient air temperature (AT) sensor 92, in-car (IC) temperature sensor 94, and evaporator outlet air temperature ($T_{eoat}$) sensor 96. The temperature sensor 96 is disposed in the outlet airstream of evaporator 24 so that the signal $T_{eoat}$ closely approximates the surface temperature of evaporator 24. Other inputs not shown in FIG. 1 include the usual operator demand inputs generated by the driver interface panel (DIP) 98, such as a desired cabin air temperature, and override controls for fan and mode. A further input according to this invention is provided by a thermistor 82 located in the evaporator condensate drainpipe 80. As explained below, thermistor 82 is used to deduce the state of the evaporator 24 for purposes of ensuring odor-free operation of the system 10.

In response to the above-mentioned inputs, the control unit 90 develops output signals for controlling the compressor clutch 16, the capacity control valve 17, the fan motor 34, the blower motor 43, and the air control doors 44, 56, 64 and 66. In FIG. 1, the output signal CL for the clutch 16 appears on line 100, the output signal STROKE for valve 17 appears on line 102, and the output signal FC for condenser fan motor 34 appears on line 104. For simplicity, output signals and actuators for the air control doors 44, 56, 64, 66 have been omitted. Additionally, the control unit 90 has the capability of generating output signals to the driver interface panel 98, such as for alerting the driver of conditions that require servicing of the system 10.

The control unit 90 may be programmed to carry out a number of different control strategies or algorithms for controlling the capacity of compressor 12. Traditional control strategies attempt to maximize evaporator cooling while preventing the formation of ice on the evaporator surface. Other control strategies, such as described in the U.S. Pat. No. 6,293,116 to Forrest et al., provide increased energy efficiency by controlling the compressor capacity to a level that achieves a desired humidity level in the vehicle cabin while minimizing re-heating of the conditioned air. Any control strategy, but particularly the high efficiency control strategies, can result in an evaporator condition favorable to the build-up of odor-causing microorganisms. However, as mentioned above, it has been demonstrated that maintaining the evaporator surface temperature below the dew point temperature produces sufficient condensate to effectively eliminate the odor problem by cleansing the evaporator surface of the odor-causing microorganisms. Accordingly, this invention provides a cost effective method and apparatus for detecting a dry or low-condensate-flow condition of the evaporator 24, in which case the capacity of the compressor can be increased to increase condensate flow for odor-free operation of the system 10.

Figure 2A:
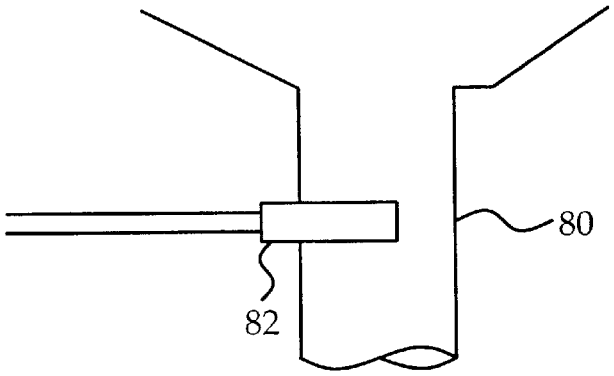
FIGS. 2A, 2B and 2C illustrate a thermistor mounted in the condensate drainpipe of FIG. 1.
Figure 2B:
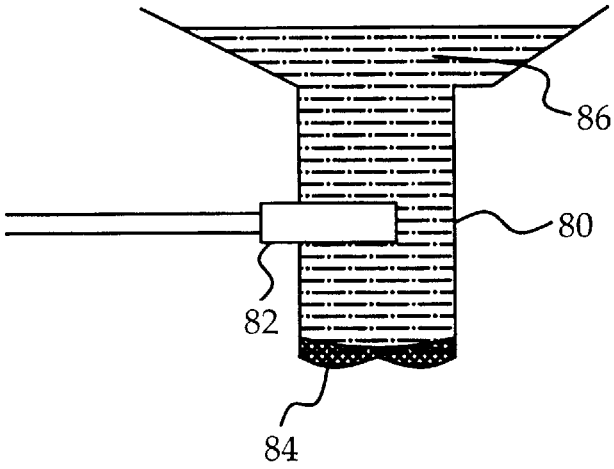
Figure 2C:
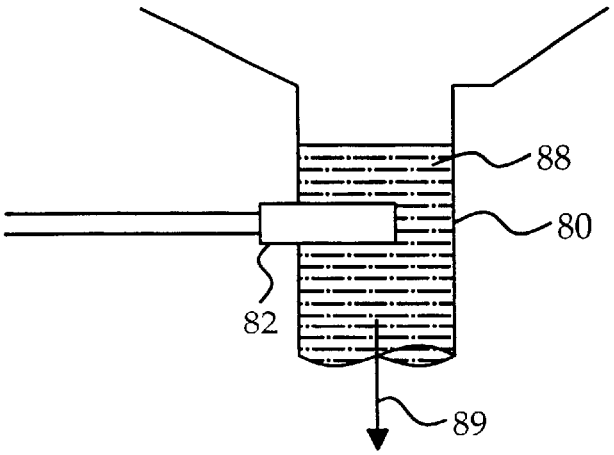

Referring to FIGS. 2A–2C, the thermistor 82 may be mounted in the condensate drainpipe 80 substantially as shown. FIG. 2A illustrates a condition where there is little or no condensate flow, and the thermistor 82 is surrounded by essentially stagnant air; the air flow is considered to be stagnant since the amount of evaporator-conditioned air escaping through the drainpipe 80 is negligible compared with the amount of air flowing through the outlets 68, 70, 72. FIG. 2B illustrates a condition where the drainpipe 80 is blocked by foreign matter 84, and the thermistor 82 is surrounded by essentially stagnant water 86. Finally, FIG. 2C illustrates a condition where there is a continuous flow of condensate 88 (indicated by arrow 89), as occurs when the evaporator surface temperature is below the dew point temperature of the inlet air. In this case, the thermistor 82 may be partially or fully contacted by flowing condensate 88.

The relationship between the surface temperature $T_s$ of thermistor 82 and its electric resistance $R_t$ for commonly used thermistor materials in which $R_t$ decreases with increasing $T_s$ is expressible as:

$$\frac{1}{T_5} = \frac{1}{T_0} + \frac{1}{\alpha}\ln\left(\frac{R_t}{R_o}\right) \quad (1)$$

where $R_o$ is the electrical resistance of thermistor 82 at reference temperature $T_o$ and $\alpha$ is the temperature coefficient of the thermistor material in °R. Thus, surface temperature $T_s$ can be easily calculated once the resistance $R_t$ has been determined.

According to the first embodiment of this invention, the surface temperature $T_s$ is used to calculate the temperature of a stagnant fluid (air or water) in the drainpipe based on the power supplied to thermistor 82 and the convective heat transfer characteristics of air and water. If the calculated temperature for air $T_{fa}$ is approximately equal to the evaporator temperature $T_{eoat}$, the thermistor 82 is surrounded primarily by stagnant air, and it is deduced that there is little or no condensate flow through the drainpipe 80. In this case, the evaporator 24 is too dry and the operating point of the air conditioning system 10 is lowered to reduce the surface temperature of the evaporator 24. If the calculated temperature for water $T_{fw}$ is approximately equal to $T_{eoat}$, the thermistor 82 is surrounded primarily by stagnant condensate, and it is deduced that the drainpipe 80 is plugged. In this case, the compressor clutch 16 is turned off and the operator is advised via driver interface panel 98 to have the air conditioning system 10 serviced. Otherwise, the evaporator 24 is deemed to be generating sufficient condensate to cleanse the evaporator surface of odor causing microorganisms, and there is no adjustment of the operating point of the air conditioning system 10.

In general, the temperature $T_f$ of a circumambient fluid in drainpipe 80 may be expressed in terms of the thermistor surface temperature $T_s$ as follows:

$$T_f = T_s - 1.0861\left(\frac{W}{dlh}\right) \quad (2)$$

where W is the electrical power in Watts supplied to the thermistor 82, d and l are the thermistor diameter and length dimensions in feet, and h is the convective heat transfer coefficient from the thermistor surface in Btu/ft$^2$hr°R. For the conditions illustrated in FIGS. 2A and 2B, the fluid surrounding the thermistor 82 is essentially stagnant, and the convective heat transfer coefficient h can be determined using the following natural convection relation for a circular cylinder presented by H. J. Merk and J. A. Prins in a paper titled *Thermal Convection in Laminar Boundary Layers I, II and III* published in Applied Scientific Research, Vol. A4, pp. 11–24, 195–206, 207–221, 1953–1954:

$$Nu = CGr^{1/4} \quad (3)$$

where C is a numerical constant having a value of 0.3988 for air and 0.9247 for water, Nu is the dimensionless Nusselt number defined as:

$$Nu \equiv \frac{hd}{k} \quad (4)$$

and Gr is the dimensionless Grashof number defined as:

$$Gr \equiv \frac{\beta\rho^2 g(T_g - T_f)d^3}{\mu^2} \quad (5)$$

where g is the acceleration due to gravity=32.174×3600$^2$ ft/hr$^2$, k is the thermal conductivity of the fluid (air or condensate) in Btu/ft hr °R, β is the coefficient of thermal expansion of the fluid in inverse °R, ρ is the density of the fluid in lb$_m$/ft$^3$, and $\mu$ is the dynamic viscosity of the fluid in lb$_m$/ft hr. Introducing Eqs. (4) and (5) into Eqs. (3) and (2) yields:

$$T_f = T_s - \left[\frac{1.0861}{Cd^{3/4}l}\left(\frac{(\mu^{1/2})}{k\rho^{1/2}}\right)\frac{W}{(\beta g)^{1/4}}\right]^{4/5} \quad (6)$$

The terms $\mu$, ρ, k and β appearing in equation (6) are specific to the fluid in drainpipe 80. At room temperature (70° F.), the expansion coefficient β is 0.001887°R$^{-1}$ for air, and 0.000176°R$^{-1}$ for condensate (water). The transport properties $\mu$, ρ and k for air and condensate (water) are as follows:

| Property | Air | Water |
|---|---|---|
| $\mu$, lb$_m$/ft hr | 0.0438 | 2.394 |
| ρ, lb$_m$/ft$^3$ | 0.0749 | 62.3 |
| k, Btu/ft hr ° R | 0.0147 | 0.347 |

Introducing the respective values of β, C, $\mu$, ρ and k for air and water into equation (6) yields the temperatures for air and for water $T_{fa}$, $T_{fw}$ as follows:

$$T_{fa} = T_s - \frac{3.4822W^{4/5}}{d^{3/5}l^{4/5}} \text{ for air} \quad (7)$$

$$T_{fw} = T_s - \frac{0.0766W^{4/5}}{d^{3/5}l^{4/5}} \text{ for water} \quad (8)$$

Thus, $T_{fa}$ gives the temperature of air in the drainpipe 80 if there is little or no condensate flow from the evaporator 24 as in FIG. 2A and $T_{fw}$ gives the temperature of stagnant condensate if the drainpipe is plugged as in FIG. 2B. Accordingly, control unit 90 compares $T_{fa}$ and $T_{fw}$ to the surface temperature $T_{eoat}$ of the evaporator 24. If $T_{eoat}$ is approximately equal to $T_{fa}$, the evaporator core is too dry and the operating point of the air conditioning system 10 is lowered to reduce the surface temperature of the evaporator 24. If $T_{eat}$ is approximately equal to $T_{fw}$, the drainpipe 80 is plugged, and the compressor 12 is disabled and the operator is advised via driver interface panel 98 to have the air conditioning system 10 serviced. If $T_{eoat}$ is a value other than $T_{fa}$ or $T_{fw}$, the evaporator 24 is deemed to be generating sufficient condensate to cleanse the evaporator surface of odor causing microorganisms, and there is no adjustment of the operating point of the air conditioning system 10.

Figure 3:
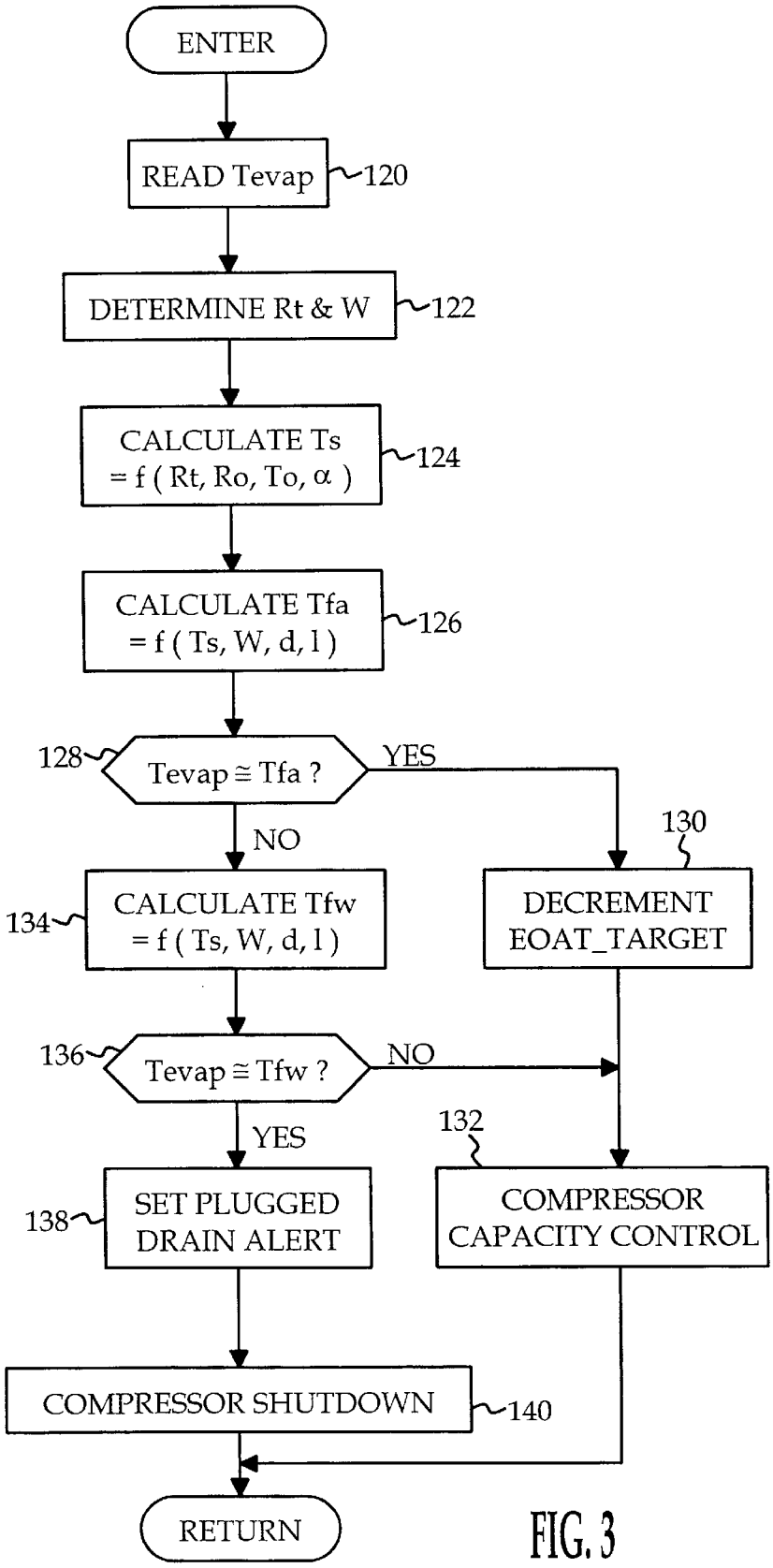
FIG. 3 is a flowchart representing a software routine periodically executed by the microprocessor-based control unit of FIG. 1 according to the first embodiment of this invention.

FIG. 3 depicts a flow diagram representative of a software routine periodically executed by the control unit 90 according to the first embodiment of this invention. The control is illustrated in the context of a compressor capacity control designated by block 132 which activates stroke control valve 17 as required to achieve a target evaporator outlet air temperature, referred to herein as EOAT_TARGET. In other words, the activation of stroke control valve 17 is adjusted based on the measured deviation of $T_{eoat}$ from EOAT_

TARGET, so as to increase the compressor capacity if $T_{eoat}$ is higher than EOAT_TARGET, and decrease the compressor capacity if $T_{eoat}$ is lower than EOAT_TARGET. Additionally, the control unit 90 adjusts the position of temperature door 56 as required to achieve a desired outlet air temperature, as discussed above.

Turning to FIG. 3, $T_{eoat}$, $R_t$ and W are determined at blocks 120 and 122. Thereafter, the thermistor surface temperature $T_s$ is calculated at block 124 using equation (6), and the corresponding temperature $T_{fa}$ of stagnant air surrounding the thermistor 82 is calculated at block 126 using equation (7). If $T_{eoat}$ is approximately equal to $T_{fa}$, as determined at block 128, the evaporator core is too dry and block 130 is executed to lower the operating point of the air conditioning system 10 by decrementing EOAT_TARGET, whereafter the capacity control block 132 is executed. Otherwise, the temperature $T_{fw}$ of stagnant water surrounding the thermistor 82 is calculated at block 134 using equation (8). If $T_{eoat}$ is approximately equal to $T_{fw}$, as determined at block 136, the drainpipe 80 is plugged; in this case, blocks 138 and 140 are executed to set a "plugged drain" alert to signal the operator via driver interface panel 98 to have the air conditioning system 10 serviced, and to execute a compressor shutdown routine for disabling further operation of compressor 12 by disengaging the compressor clutch 16. If blocks 128 and 136 are both answered in the negative, the evaporator 24 is deemed to be generating sufficient condensate to cleanse the evaporator surface of odor causing microorganisms, and the system 10 is allowed to continue operating normally.

Figure 4:
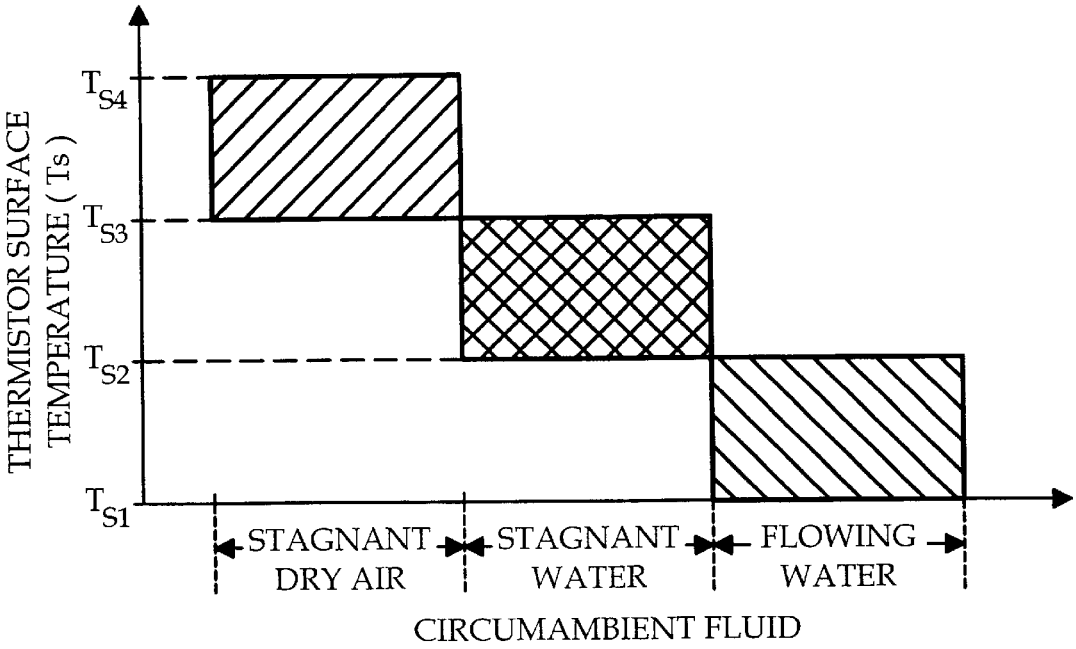
FIG. 4 is a graph depicting a set of sensor temperature ranges according to the second embodiment of this invention.

According to the second embodiment of this invention, the control unit 90 supplies constant power to the thermistor 82, and its surface temperature $T_s$ is compared to a set of predefined reference temperatures to deduce the operating state of evaporator 24. FIG. 4 graphically depicts a set of reference temperatures $T_{s1}$, $T_{s2}$, $T_{s3}$, $T_{s4}$ determined experimentally under operating conditions of the evaporator 24 that result in three different types of circumambient drainpipe fluid. The reference temperatures $T_{s1}$ and $T_{s2}$ define a first range of thermistor surface temperatures observed when the surface of evaporator 24 is too dry and the circumambient fluid is stagnant air. If the thermistor surface temperature $T_s$ falls within the first range, the operating point of the system 10 is lowered to reduce the surface temperature of the evaporator 24. The reference temperatures $T_{s2}$ and $T_{s3}$ define a second range of thermistor surface temperatures observed when the drainpipe 80 is plugged and the circumambient fluid is stagnant water/condensate. If $T_s$ falls within the second range, the compressor 12 is disabled and the operator is advised to have the system serviced. Finally, the reference temperatures $T_{s3}$ and $T_{s4}$ define a third range of thermistor surface temperatures observed when the evaporator 24 is generating sufficient condensate to cleanse the evaporator surface of odor causing microorganisms and the circumambient fluid is flowing water/condensate. If $T_s$ falls within the third range, the system 10 is allowed to continue operating normally.

Figure 5:
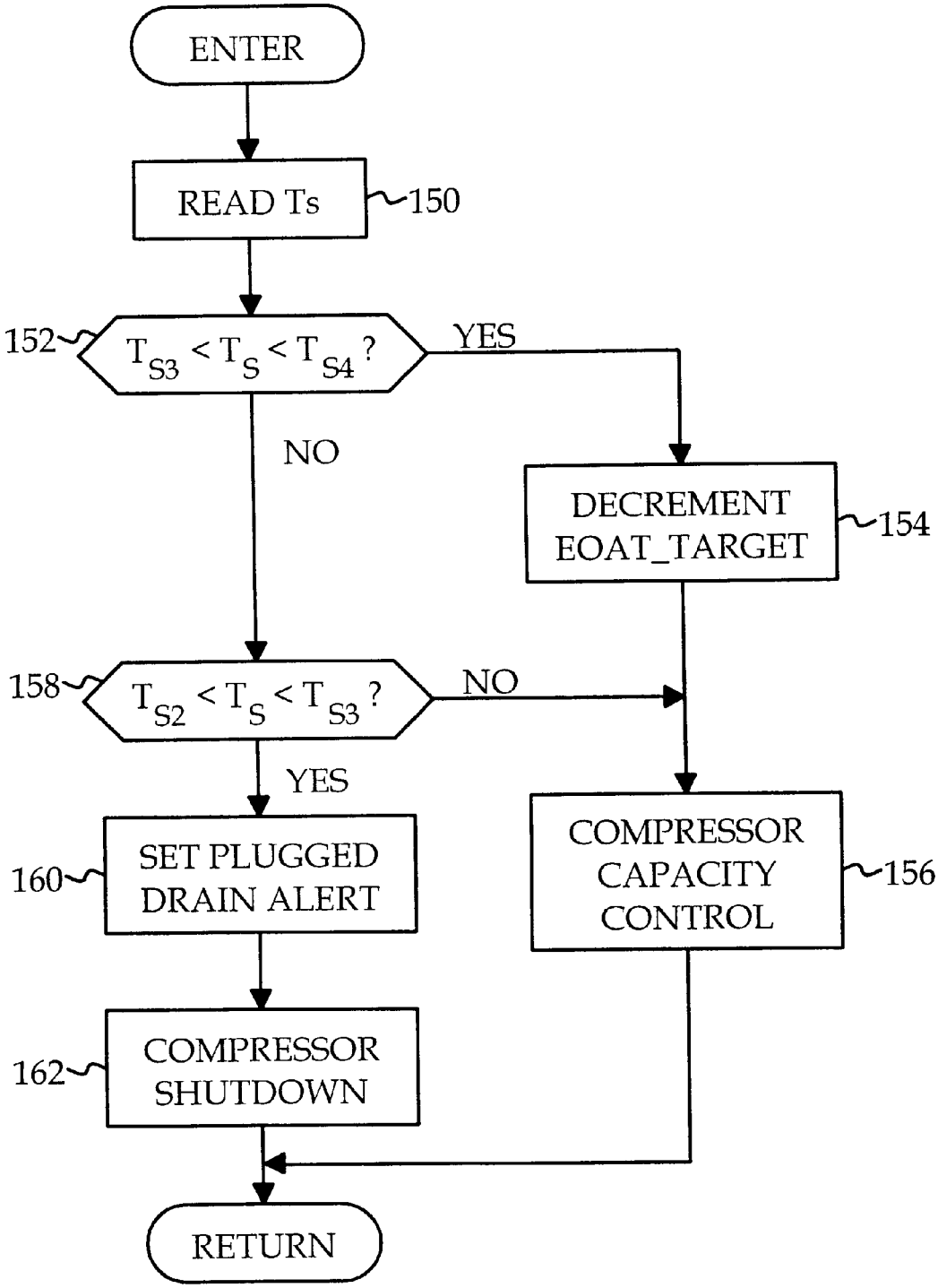
FIG. 5 is a flowchart representing a software routine periodically executed by the microprocessor-based control unit of FIG. 1 according to the second embodiment of this invention.

The control method outlined in the preceding paragraph is illustrated by the flow diagram of FIG. 5, which represents a software routine periodically executed by the control unit 90 according to the second embodiment of this invention. Similar to the first embodiment, the control according to the second embodiment is illustrated in the context of a compressor capacity control (designated by block 156) which activates stroke control valve 17 as required to achieve a target evaporator outlet air temperature EOAT_TARGET. The thermistor surface temperature $T_s$ is calculated at block 150 using equation (1). If $T_s$ falls within the temperature range defined by reference temperatures $T_{s3}$ and $T_{s4}$, as determined at block 152, the evaporator core is too dry and block 154 is executed to lower the operating point of the air conditioning system 10 by decrementing EOAT_TARGET, whereafter the capacity control block 156 is executed. If the block 152 is answered in the negative, the block 158 is executed to determine if $T_s$ falls within the temperature range defined by reference temperatures $T_{s2}$ and $T_{s3}$. If so, the drainpipe 80 is plugged, and the blocks 160 and 162 are executed to set a "plugged drain" alert to signal the operator via driver interface panel 98 to have the air conditioning system 10 serviced, and to execute a compressor shutdown routine for disabling further operation of compressor 12 by disengaging the compressor clutch 16. If blocks 152 and 158 are both answered in the negative, $T_s$ is presumed to be lower than the reference temperatures $T_{s2}$, which means that the evaporator 24 is generating sufficient condensate to cleanse the evaporator surface of odor causing microorganisms. In this case, the block 156 is executed to perform the usual compressor capacity control, and the system 10 is allowed to continue operating normally.

In summary, the present invention ensures odor-free operation of an air conditioning system without the use of expensive sensors, and additionally provides detection of a plugged condensate drainpipe. While described in reference to the illustrated embodiment, it is expected that various modifications in addition to those mentioned above will occur to those skilled in the art. For example, a hot wire anemometer or other electrically activated temperature sensor may be used instead of the thermistor 82. Further, the evaporator surface temperature $T_{eoat}$ may be determined from the evaporator inlet refrigerant pressure, if desired, by calculating the saturation refrigerant temperature in the evaporator to provide a close first order estimate of the discharge air temperature $T_{eoat}$. For a more detailed discussion of this approach, see the SAE conference paper *Enhancement of R*-134a *Automotive Air Conditioning System* (SAE No. 1999-01-0870) presented by M. S. Bhatti in Detroit, Mich. in March, 1999. Yet another way of estimating $T_{eoat}$ is to experimentally map out the discharge air temperature at the evaporator face as a function of the compressor rotational speed, compressor displacement rate, HVAC blower speed, and/or ambient air temperature. Since the discriminating relations of Eqs. (7) and (8) used to ascertain the state of evaporator surface are substantially insensitive to the evaporator surface temperature, even the approximate values of the evaporator surface temperature provided by the aforementioned measurements can provide good indication of the state of the evaporator surface. Various modifications to the control algorithms of FIGS. 3 and 5 are also possible; for example, the algorithm of FIG. 3 can be implemented with fewer than three reference temperatures if the detection of a plugged drainpipe is omitted, and so on. In this regard, it should be understood that the scope of this invention is defined by the appended claims, and that systems and methods incorporating the above and other modifications may fall within the scope of such claims.

What is claimed is:

1. A method of operation for an air conditioning system including an evaporator which receives chilled refrigerant for conditioning inlet air passing through the evaporator, and a condensate drainpipe for collecting and draining condensate that forms on a surface of the evaporator, the method comprising the steps of:

installing an electrically activated temperature sensor in said drainpipe;

determining a surface temperature of said temperature sensor;

detecting a first condition for which said temperature sensor is surrounded primarily by substantially stagnant air based on the determined surface temperature of said temperature sensor; and increasing a capacity of said air conditioning system in response to detection of said first condition for lowering a surface temperature of said evaporator to produce condensate sufficient to cleanse odor-causing microorganisms from the surface of said evaporator.

2. The method of claim 1, wherein the step of detecting said first condition includes the steps of:

experimentally determining a first range of surface temperatures of said temperature sensor that occur during operation of said system when an electrical power supplied to said sensor is substantially constant and the condensate that forms on said evaporator surface is insufficient to cleanse said odor-causing microorganisms from the surface of said evaporator; and detecting said first condition when the determined surface temperature is within said first range of surface temperatures.

3. The method of claim 1, wherein the step of detecting said first condition includes the steps of:

calculating a first temperature of a stagnant fluid in said drainpipe based on an electrical power supplied to said temperature sensor and a convective heat transfer characteristic of air; and detecting said first condition when said first temperature is approximately equal to a surface temperature of said evaporator.

4. The method of claim 1, including the steps of:

detecting a second condition for which said temperature sensor is surrounded primarily by stagnant condensate; and indicating that said drainpipe is plugged in response to detection of said second condition.

5. The method of claim 4, wherein the step of detecting said second condition includes the steps of:

experimentally determining a second range of surface temperatures of said temperature sensor that occur during operation of said system when an electrical power supplied to said sensor is substantially constant and said temperature sensor is surrounded by stagnant condensate; and detecting said second condition when the determined surface temperature is within said second range of surface temperatures.

6. The method of claim 4, wherein the step of detecting said second condition includes the steps of:

calculating a second temperature of a stagnant fluid in said drainpipe based on an electrical power supplied to said temperature sensor and a convective heat transfer characteristic of water; and detecting said second condition when said second temperature is approximately equal to a surface temperature of said evaporator.

7. The method of claim 4, wherein said air conditioning system includes electrically activated apparatus for producing said chilled refrigerant, and said method includes the step of:

deactivating said apparatus in response to detection of said second condition.

8. The method of claim 1, wherein the step of increasing a capacity of said air conditioning system includes the step of decreasing a target outlet air temperature of said evaporator.

9. Air conditioning apparatus including an evaporator which receives chilled refrigerant for conditioning inlet air passing through the evaporator, and a condensate drainpipe for collecting and draining condensate that forms on a surface of the evaporator, further comprising:

an electrically activated temperature sensor disposed in said drainpipe; and a controller for determining a surface temperature of said temperature sensor and increasing a capacity of said air conditioning apparatus when the determined surface temperature indicates that said temperature sensor is surrounded primarily by substantially stagnant air.

10. The apparatus of claim 9, wherein said controller indicates a plugged drainpipe condition when the determined surface temperature indicates that said temperature sensor is surrounded primarily by stagnant condensate.

11. The apparatus of claim 9, including a compressor for producing said chilled refrigerant, wherein said controller disables said compressor when the determined surface temperature indicates that said temperature sensor is surrounded primarily by stagnant condensate.

12. The apparatus of claim 9, wherein said temperature sensor is a thermistor.

* * * * *